United States Patent [19]

Sahakian et al.

[11] Patent Number: 5,059,263

[45] Date of Patent: Oct. 22, 1991

[54] LARGE GAUGE INSULATED CONDUCTOR AND COAXIAL CABLE, AND PROCESS FOR THEIR MANUFACTURE

[75] Inventors: Jack A. Sahakian; John C. Hostler, both of Flagstaff, Ariz.

[73] Assignee: W. L. Gore & Associates, Inc., Newark, Del.

[21] Appl. No.: 231,570

[22] Filed: Aug. 12, 1988

[51] Int. Cl.[5] ..... H01B 13/06

[52] U.S. Cl. ..... 156/56; 174/110 FC; 174/120 R; 174/120 SR

[58] Field of Search ..... 174/110 FC, 120 R, 120 SR, 174/102 R, 107; 156/52, 53, 56

[56] References Cited

U.S. PATENT DOCUMENTS

| | | | |
|---|---|---|---|
| 3,429,982 | 2/1969 | Brown | 174/110 FC |
| 3,790,697 | 2/1974 | Buckingham | 174/107 X |
| 4,484,023 | 11/1984 | Gindrup | 174/107 X |
| 4,529,564 | 7/1985 | Harlow | 174/110 FC X |
| 4,552,989 | 11/1985 | Sass | 174/107 X |
| 4,626,810 | 12/1986 | Nixon | 174/110 FC X |
| 4,701,576 | 10/1987 | Wada et al. | 174/117 F |
| 4,826,725 | 5/1989 | Harlow | 174/110 FC X |

FOREIGN PATENT DOCUMENTS

| | | | |
|---|---|---|---|
| 921453 | 3/1963 | United Kingdom | 174/110 FC |

OTHER PUBLICATIONS

Fibrous, Porous TFE Provides Dimensional Stability for High Temperature, Low Loss Coaxial Cable, Insulation/Circuits, Jun. 1971, p. 19.

*Primary Examiner*—Morris H. Nimmo

*Attorney, Agent, or Firm*—Gary A. Samuels

[57] ABSTRACT

Coaxial electric cable and simplified process for making it, wherein large gauge center conductor is wrapped with extruded strands of porous expanded polytetrafluoroethylene, drawn through a die to reduce diameter and voids, tape-wrapped with porous expanded polytetrafluoroethylene, sintered, and shielding and extruded jacketing applied.

6 Claims, 2 Drawing Sheets

LARGE GAUGE INSULATED CONDUCTOR AND COAXIAL CABLE, AND PROCESS FOR THEIR MANUFACTURE

FIELD OF THE INVENTION

This invention relates to a simplified process for producing large gauge coaxial cables having porous expanded polytetrafluoroethylene (PTFE) insulation and having conductor sizes in the range of about zero to 20 gauge.

BACKGROUND OF THE INVENTION

There is a need for such large conductors for commercial, military, and aerospace applications, such as test equipment and submarine wiring, airframe routing of communication and control signals, control "black" box interconnectors, and television and radio equipment signal routing. A desirable product would have light weight, small size, and excellent electrical performance. It has been difficult in the past, however, to achieve this combination of desirable properties owing to problems associated with extruding thick layers of porous insulation over large electrical conductors consistently without loss of electrical performance characteristics.

Early methods comprised spacing the conductor from the surrounding metal screen by braiding flexible cords, tubes or strands of insulation in a pattern between the two metal layers and optionally filling the space between the strands with an insulating gas or insulating liquid, such as described in U.S. Pat. Nos. 2,488,211 to Lemon and 2,585,484 to Menes. Another method utilized was to surround the center conductor of a cable with insulating tubes, which could be of various shapes, and bind them by a winding of insulating tape to the conductor, then apply a metallic shield, much as shown in U.S. Pat. No. 3,126,436.

A method differing in kind was a process to extrude a layer of PTFE insulation onto a conductor, stretch, and sinter in a single pass to yield an electric conductor covered by a low density PTFE insulation. This process, shown in U.S. Pat. No. 4,529,564, involved a complex way to move the conductor and insulation at differing rates to stretch the insulation, and to heat the stretched insulation to heat-set its structure at about the time the rate of insulation movement caught up to that of the conductor.

SUMMARY OF THE INVENTION

The present invention provides a large gauge insulated core for a coaxial cable and simplified processes for its manufacture and manufacture of a coaxial cable therefrom. The core embodies a large metal center conductor of about zero to 20 gauge. Wrapped or placed about the conductor are several strands, between 2 and 20, but usually about six, of 0 to 100% sintered porous expanded PTFE which may be prepared by any known method. The wrapped strands are then passed through a sizing die where the insulating strands are compacted together to eliminate most of the voids from around the center conductor. The PTFE cord or strand enclosed conductor is next wrapped with at least one layer of porous expanded PTFE binding tape. The entire construction is then heated to fuse any unsintered insulation into a unitary mass around the center conductor.

The core may then be converted to a coaxial cable by application of conductive shielding material, and the shielded core then covered with an outer protective jacket, usually of extruded thermoplastic material.

DESCRIPTION OF THE PREFERRED EMBODIMENTS

Figure 1:
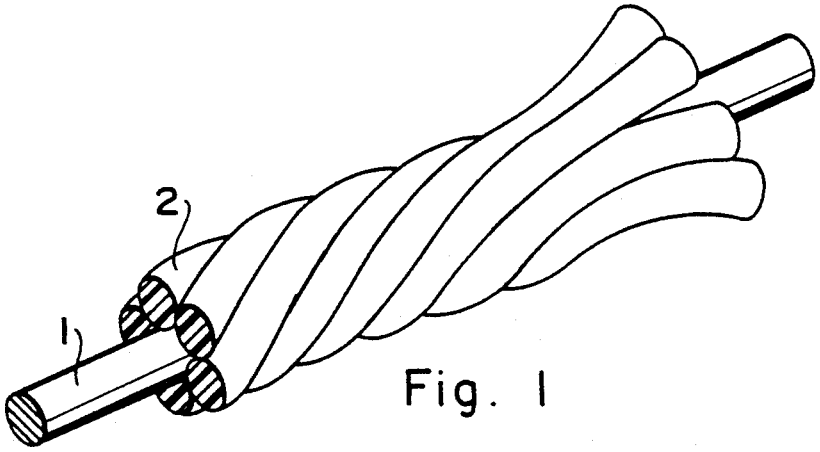
FIG. 1 depicts a perspective view of a piece of conductor wrapped with strands of porous expanded PTFE.
Figure 2:
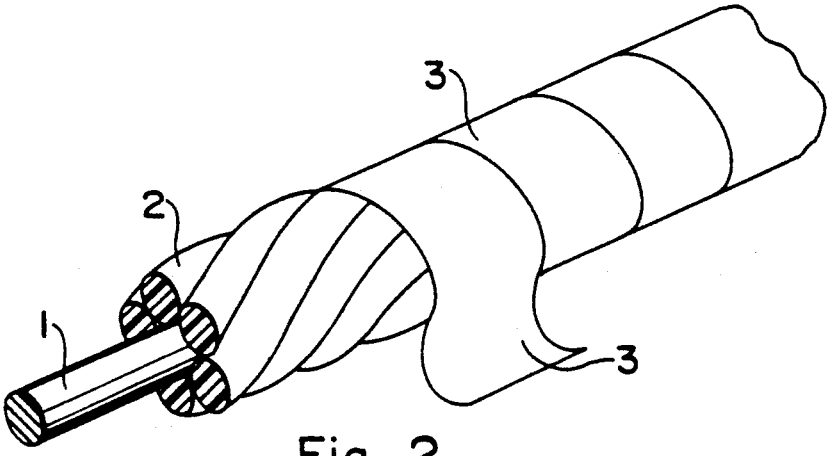
FIG. 2 shows the construction of FIG. 1 wrapped with porous expanded PTFE tape.
Figure 3:
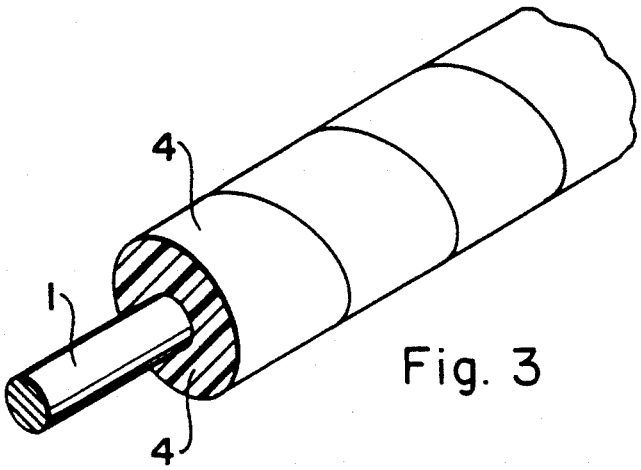
FIG. 3 describes a construction of FIG. 2 which has been sintered to give a unitary mass of insulation surrounding the conductor.

Referring now to the figures to more clearly describe the invention, a large gauge, preferably about zero to about 20 gauge metal conductor 1 as shown in FIG. 1 is wrapped by means of standard wire making machinery with several strands 2 of porous expanded PTFE placed about a metal conductor 1 of the desired metal composition, such as copper, copper alloy, steel, or stainless steel, aluminum or an aluminum alloy, or any metal or metal alloy or other conductive material known in the art to be useful under these conditions or in this application or for this type of cable. The conductor may be solid or stranded. The strand-wrapped construction is passed through a sizing die to remove most of the air and/or voids between strands 2 and conductor 1 and at least one layer of binder tape 3 of porous expanded PTFE material is wrapped around the sized construction as described in FIG. 2. Additional PTFE binder tape or tape of other PTFE materials or other polymer materials may be wrapped about the construction before or after it is passed through the sizing die. The sized construction is now at least partially sintered at or near the sintering point of porous expanded PTFE for the required length of time to form a unitary construction of insulation 4 on conductor as depicted in FIGS. 3 and 4 and the construction cooled.

The strands 2 of porous expanded PTFE are prepared by extruding emulsion fine powder PTFE mixed with an extrusion aid, usually an organic solvent or hydrocarbon, by any of many methods well known in the art, removing the extrusion aid by art methods, then stretching or expanding the strand by a method disclosed in any one of U.S. Pat. Nos. 3,953,566, 3,962,153, 4,096,227 or 4,187,390 to give a highly stretched porous unsintered soft strand, suitable for insulating an electric conductor. Tape 3 for winding about strands 2 is similarly manufactured by extrusion, calandering, and stretching according to the above methods which are hereby incorporated by reference.

The resulting process is a high speed process, very economical in production of long lengths of cable with minimal scrap. The electrical and physical characteristics are both excellent for such a simple product produced by such a simple process which changes the physical structure from that of several separate pieces of material to a unitary mass of considerable mechanical integrity, the dielectric or insulation having been converted from a soft unstable material to a stable relatively much tougher stronger material. A uniform dielectric constant for the cable or construction is thus insured.

Figure 4:
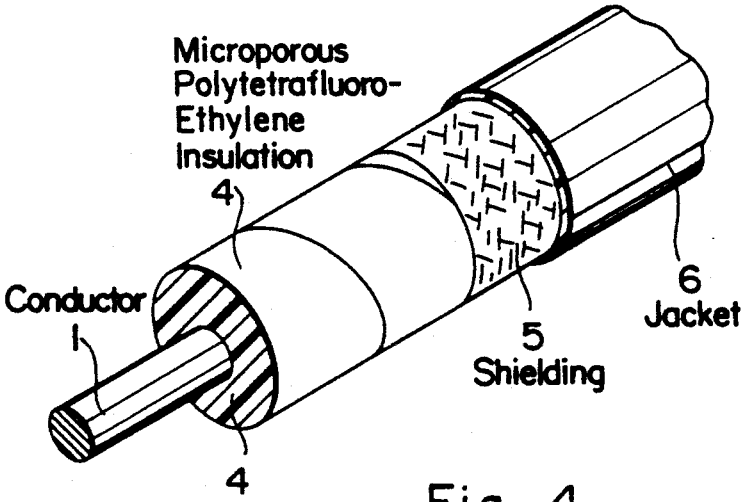
FIG. 4 shows a coaxial cable prepared from a construction of FIG. 3 which has a metal wire shield braided around it followed by an extruded thermoplastic polymer protective jacket.

Following the above process, the resulting cable or construction may be converted to a coaxial cable, such as in FIG. 4, by shielding by methods or processes well known in the art with served wrapped shielding, braided metal shielding 5, or a metallized plastic tape shielding, such an aluminized polyester tape, followed by an outer protective jacket 6, either wrapped, or usually extruded, of a thermoplastic material, such as polyvinyl chloride or polyethylene, for example. The resulting coaxial cable has light weight, small size, and excellent electrical performance, and is fast and economical to manufacture.

The cables of the invention are significantly advantageous in holding the conductor on center under flexure of the cable, can provide thick insulation on large conductors by easy methods of manufacture without loss of electrical performance, and have superior electrical performance characteristics.

While the invention has been disclosed in terms of certain embodiment and detailed descriptions, it will be clear to one skilled in the art that modifications or variations of such details may be made without deviating from the essential concepts of the invention, and such modifications and variations are considered to be limited only by the claims appended below.

We claim:

1. A process for manufacturing an insulated electric conductor comprising the steps:

(a) enclosing a conductor with one or more strands of porous expanded polytetrafluoroethylene;

(b) passing the enclosed conductor through a sizing die to reduce its size and to remove most voids between stands and conductor;

(c) wrapping said conductor with porous expanded polytetrafluoroethylene binder tape;

(d) sintering said bound conductor at or near the sintering point of porous expanded polytetrafluoroethylene for the required length of time to form a unitary construction; and (e) cooling said unitary construction.

2. A process of claim 1, wherein the conductor is about zero gauge to about 20 gauge.

3. A process of claim 2 wherein said stand of porous expanded polytetrafluoroethylene has been prepared by extrusion.

4. A process of claim 3 wherein the strand wrapped conductor is wrapped with additional tape before passing said wrapped conductor through said sizing die.

5. A process of claim 1 wherein the number of strands enclosing said conductor comprises the range two to twenty.

6. A process of claim 3 wherein the strand wrapped conductor is wrapped with additional tape after passing said wrapped conductor through said sizing die.

* * * * *